United States Patent [19]

Horne

[11] 4,192,323

[45] Mar. 11, 1980

[54] APPARATUS AND METHOD FOR AUTOMATICALLY CONTROLLING CURING CONDITIONS IN A TOBACCO CURING BARN

[75] Inventor: William P. Horne, Charlotte, N.C.

[73] Assignee: Gas-Fired Products, Inc., Charlotte, N.C.

[21] Appl. No.: 835,232

[22] Filed: Sep. 21, 1977

[51] Int. Cl.[2] ..... A24B 3/04; A24B 3/12

[52] U.S. Cl. ..... 131/135; 131/140 R; 432/500

[58] Field of Search ..... 34/48, 50; 131/133–138, 140 R; 432/37, 500

[56] References Cited

U.S. PATENT DOCUMENTS

| | | | |
|---|---|---|---|
| 3,203,265 | 8/1965 | Flegel | 74/124 |
| 3,502,085 | 3/1970 | Wochnowski | 131/135 |
| 3,503,137 | 3/1970 | Wilson | 34/45 |
| 3,664,034 | 5/1970 | Wilson et al. | 131/140 R |
| 3,927,683 | 12/1975 | Wilson et al. | 131/140 R |
| 3,937,227 | 2/1976 | Azumano | 131/134 |

OTHER PUBLICATIONS

*The Flue Cured Tobacco Farmer*, 3 (4) 6, 10, "Go Modern! with Tobacco Curing," by James Shepard, 3/15/1966.

*Chronica Naturea*, Deel 104, AFL. 5, MEI 1948, "Constant Wet-Bulb Temperature for Proper Flue Curing of Tobacco," by Dr. Ir H. A. Middleburg.

*Transactions of the American Society of Agricultural Engineers*, vol. 12, No. 5, pp. 706–709, 1969; "Temperature Differential as a Control Parameter in Tobacco Curing," by L. M. Sykes and W. H. Johnson.

*Primary Examiner*—V. Millin

*Attorney, Agent, or Firm*—Bell, Seltzer, Park & Gibson

[57] ABSTRACT

An improved apparatus and method for bulk curing tobacco in which the temperature conditions in the tobacco curing barn are automatically controlled by heating the air being circulated through the barn in a controlled manner to maintain a predetermined differential in the dry bulb temperature of the air entering and leaving the curing chamber.

14 Claims, 4 Drawing Figures

APPARATUS AND METHOD FOR AUTOMATICALLY CONTROLLING CURING CONDITIONS IN A TOBACCO CURING BARN

This invention relates to the curing of tobacco, and more particularly to an apparatus and method for bulk curing tobacco.

BACKGROUND OF THE INVENTION

In curing tobacco by the procedure generally referred to as the "bulk curing" method, tobacco leaves are loaded in a relatively compact mass in racks or in containers and placed inside of an enclosed curing barn where a furnace circulates a forced flow of heated air through the mass of tobacco leaves to effect curing and drying.

In the first stage of the curing process, known as the "yellowing" stage, the tobacco is heated to temperatures on the order of 100° F. under relatively high humidity conditions to promote certain chemical reactions in the tobacco which cause the green leaves to turn yellow. Once the tobacco is sufficiently yellowed, the relative humidity in the barn is reduced and the temperature of the air is increased. These conditions set or fix the color in the leaf and promote drying of the tobacco leaves—first of the relatively thin leafy portion of the leaves, and later drying of the relatively thicker stem portions.

In each stage of the curing process, the temperature and humidity conditions within the barn must be carefully controlled. Departure from the proper curing conditions may result in inferior quality of the cured tobacco or even in total loss of the tobacco in the barn.

To insure that the proper curing conditions are maintained, it is conventional procedure to follow a preestablished schedule of temperature and humidity conditions during the various stages of curing.

By way of example, a typical curing schedule for use in a bulk curing barn might call for maintaining a 100° F. temperature in the barn after initially loading the barn with tobacco and until yellowing is completed. During this time little or no fresh air is introduced into the barn so that the humidity is maintained at a relatively high level of about 85 to 95 percent relative humidity. After yellowing is accomplished to a sufficient degree, the temperature is then advanced to 2° F. per hour up to 130° F., and then maintaining 130° F. until all of the leafy portions of the tobacco leaves are dry. During this time fresh air is introduced into the barn to reduce the relative humidity and promote drying. Then the temperature is again advanced at 2° F. per hour up to 160° F. to accomplish drying or killing of the stems. Typically this curing schedule might take about six days.

Control over the temperature during each stage of the cure is conventionally done with either manually set thermostats, or with the use of automatic temperature advance thermostats. For examples of the use of automatic temperature advance devices, reference may be made to the Flegel U.S. Pat. No. 3,203,265 issued Aug. 31, 1965 and Wilson U.S. Pat. No. 3,503,137 issued Mar. 31, 1970.

The use of a pre-established curing temperature schedule is at best an arbitrary approximation of the time and temperatures required for curing tobacco grown under average conditions. Often such a schedule does not provide the optimum curing conditions needed for the characteristics of a particular cropping of leaf. It is well known for example that the characteristics of tobacco leaves vary depending upon the location of the leaf on the tobacco plant, as well as upon growing conditions. Tobacco grown in relatively wet weather is quite different from tobacco grown in drier weather, releasing its moisture at a different rate, and consequently requiring different curing conditions.

OBJECTS AND SUMMARY OF THE INVENTION

With the foregoing in mind, it is a primary object of the present invention to provide an improved method and apparatus for bulk curing tobacco which eliminates reliance upon arbitrary pre-established curing temperature schedules.

More particularly, it is an object of the present invention to provide an apparatus and method wherein the tobacco sets its own optimum curing temperature schedule dependent upon the conditions of the tobacco.

It is a further object of this invention to provide a more reliable method and apparatus for bulk curing tobacco which reduces the likelihood of damaging or improperly curing the tobacco, as might occur for example as a result of abnormal conditions such as a power interruption or excessive outdoor temperature variations.

It has long been recognized that as dry air passes across the tobacco leaves in a curing barn, evaporation of water from the tobacco leaf results in cooling of the air. The present invention is founded upon the recognition that the evaporative cooling which naturally occurs as the air passes across the tobacco leaves can be utilized as a parameter to control the curing conditions in the barn. In accordance with the present invention, a controlled temperature drop of the air across the tobacco is used to control the temperatures of the air during both the yellowing stage of curing and also during the subsequent drying of the leaf and stem portions of the tobacco.

It has been found in accordance with the present invention that controlled curing conditions highly conducive to proper yellowing are achieved when the air being circulated through the tobacco in the barn is heated so as to maintain a relatively small temperature drop across the tobacco, preferably on the order of about 3° to 10° F. This results in a slow, controlled rate of drying during the yellowing stage. The present invention recognizes that it is much more important during the yellowing stage to maintain a slow controlled rate of drying than it is to adhere to an arbitrary temperature schedule, and the relatively small temperature differential maintained during yellowing in accordance with this invention insures that a slow, controlled rate of drying is maintained at all times during the yellowing stage.

In the leaf drying stage, on the other hand, it is important to produce a fairly rapid drying of the leaf to preserve the leaf in its yellow condition. This is accomplished in accordance with the present invention by heating the air being directed through the tobacco so as to maintain the temperature differential across the tobacco at a relatively higher level, preferably within the range of about 15° to 25° F.

During the early stages of leaf drying when the tobacco has a relatively high moisture content, the air passing through the tobacco will produce the predetermined amount of evaporative cooling at a relatively low temperature. On the other hand, when the tobacco is somewhat drier, a higher temperature will be required to produce the same preset temperature drop across the tobacco. By controlling the heater to maintain a predetermined substantially constant temperature drop across the tobacco, the heater will be automatically controlled to advance the temperature at a relatively slow rate while the tobacco contains a large amount of moisture, but at a more rapid rate as the tobacco dries out. In this way the tobacco sets its own optimum curing temperature schedule depending upon the conditions of the tobacco.

Arbitrary curing schedules may often be too long for the actual requirements of particular tobacco being cured, thus resulting in a waste of time and energy, and reduction of market value of the tobacco as a result of excessive weight loss. The present invention, by automatically providing the fastest rate of cure under proper conditions, thus results in a savings of both energy and time, maximizing the use and availability of the curing barn.

Broadly stated, the method of curing tobacco in accordance with this invention involves directing air in a recirculating flow into and through the curing chamber of a bulk curing barn and into contact with the tobacco leaves disposed in the curing chamber, while sensing the dry bulb temperature of the air entering and leaving the curing chamber, and while heating the air directed into the curing chamber in response to the sensed dry bulb temperature of the air so as to maintain a predetermined differential in the dry bulb temperature of the air entering and leaving the tobacco.

The apparatus for bulk curing tobacco in accordance with this invention comprises a curing barn, with means provided in the curing barn defining a tobacco curing chamber adapted for receiving tobacco leaves for curing, and including an inlet and an outlet for the flow of air in and out of the curing chamber, and with means defining an air passageway communicating with the inlet and outlet of the curing chamber for directing air in a recirculating flow into and through the curing chamber. A fan is provided cooperating with the air passageway for inducing a forced flow of air therealong and through the curing chamber and into contact with the tobacco leaves disposed in the curing chamber. A heater is provided cooperating with the air passageway for heating the air flowing along the air passageway and through the curing chamber. First and second dry bulb temperature sensors are located in the path of the air flow respectively adjacent the inlet and outlet of the curing chamber, these sensors being operable for sensing the dry bulb temperature of the air upon entering and leaving the curing chamber. A differential temperature control device is operatively associated with the heater and responsive to the first and second temperature sensors for controlling the operation of the heater to maintain a predetermined differential of dry bulb temperature between the first and second temperature sensors.

As noted earlier, the method and apparatus features of the present invention are useful in maintaining control over the conditions of the air during both the yellowing stage of curing and also during the subsequent drying of the leaf and stem portions of the tobacco. During the yellowing stage, the dry bulb temperature drop across the tobacco is preferably maintained at a relatively small differential of about 3° to 10° F. to prevent excessive drying. Preferably during this time, the heating of the air is also controlled to insure that the air does not exceed a predetermined maximum limit temperature of about 100°0 F. During the yellowing stage, the fresh air dampers are maintained in a closed or slightly open position to maintain relatively high humidity conditions within the barn. As a result, the tobacco is heated only to relatively low temperatures and moisture is removed from the tobacco slowly and in a controlled manner while yellowing takes place.

Once yellowing is completed to a sufficient degree, the heating of the air is controlled to maintain a relatively greater dry bulb temperature differential within the range of about 15°–25° F., while preventing the air entering the tobacco from exceeding a temperature of about 165° F. by means of a high limit thermostat. During this phase of curing, drying is promoted by opening the fresh air dampers to introduce outside air into the barn and thereby reduce the relative humidity within the barn.

In a preferred aspect of the invention, the above described apparatus and method for automatically controlling the operation of the heater to maintain a constant temperature differential across the tobacco is utilized in conjunction with automatic positioning of the fresh air dampers. More particularly, a wet bulb temperature sensor is provided in the path of the flowing air within the barn, and the positioning of the dampers is controlled to maintain the mixture of fresh and recirculated air at a predetermined substantially constant wet bulb temperature. During yellowing, the wet bulb temperature control preferably is set at a temperature within the range of 90° to 100° F., and most desirably to a temperature within this range which substantially corresponds to the maximum limit temperature during yellowing minus the temperature differential maintained by the differential thermostat. During the drying phase of the curing operation the wet bulb temperature is normally maintained at a substantially constant level within the range of 90° F. to 100° F.

The present invention provides much more effective control during the yellowing phase of curing than is presently provided by an arbitrary temperature schedule. The present invention is particularly well-suited for maintaining desirable conditions for yellowing under widely varying ambient temperature conditions where arbitrary curing temperatures often fail. For example, when the outdoor temperature falls markedly at night, as often occurs in many northern locations, the reduced humidity in the air, together with the increased burner output in order to maintain a predetermined arbitrary temperature in the barn, may result in overdrying of the tobacco and prematurely setting the color of the tobacco before yellowing is completed. The differential temperature control of this invention avoids premature color setting by maintaining a constant temperature differential across the tobacco (and thus a constant and controlled rate of drying), even if this results in the barn cooling down as a result of reduced outdoor temperatures.

Another advantage of the present invention is the capability of rapidly setting the color of the tobacco once the desired amount of yellowing has been achieved. In accordance with the prior arbitrary curing temperature schedules, it has been necessary to advance the temperature at a gradual rate (e.g., no more than about 2° F. per hour) once yellowing is completed and color setting and drying are begun. Uncontrolled sudden changes in temperature may result in hot moist air from the tobacco located near the air inlet being cooled as the air progresses through the cooler tobacco farther downstream, with the moisture condensing on the cooler tobacco leaves and damaging the tobacco in a process known as "scalding." However, the gradual temperature advance which is utilized to avoid this possibility may not set the color quickly enough and allow yellowing to continue too far.

The present invention, by maintaining a pre-set temperature differential across the tobacco, permits more rapidly arresting the yellowing process and setting the color, while maintaining effective control over the air conditions in the barn to prevent the possibility of damaging the tobacco by scalding.

Still another advantage of the differential temperature control of this invention is the ability to properly restore control of the curing conditions after power outages. In a bulk curing barn controlled by a conventional thermostat, if a power outage should occur during the curing cycle, upon restarting the thermostat will open up and call for full burner output in order to bring the barn back to the predetermined temperature called for by the thermostat. This may result in heating the tobacco too rapidly and thereby damaging the tobacco. The differential temperature control of the present invention would resume control of the tobacco at the temperature then existing when the power is restored, and even if the barn had cooled down significantly, would bring the barn back up to temperature in a controlled, gradual manner thereby avoiding overheating of the tobacco.

Some of the objects, features and advantages of the invention having been stated, others will become apparent from the following detailed description, when taken in connection with the accompanying drawings, in which—

Figure 1:
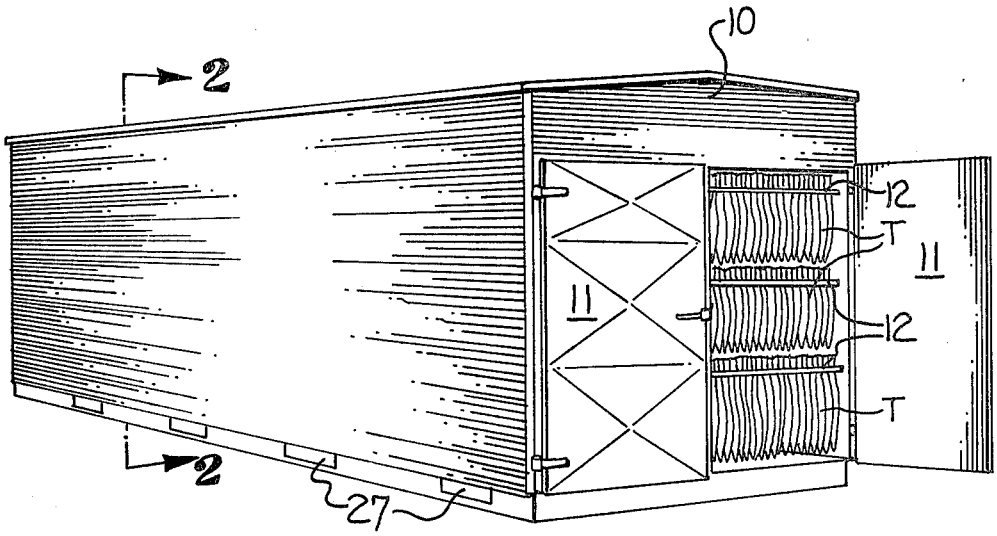
FIG. 1 is a perspective view of one end portion of a tobacco bulk curing barn and showing the racks of tobacco leaves inside the barn.

Referring now more particularly to the drawings, the bulk curing barn illustrated in FIG. 1 comprises an elongate rectangular housing 10 having doors 11 at one end thereof to provide access to a curing chamber within the barn to facilitate loading and unloading tobacco therein for curing. As illustrated, the tobacco T is supported in the curing chamber on a plurality of tobacco racks 12 arranged in three tiers inside the curing chamber.

Figure 2:
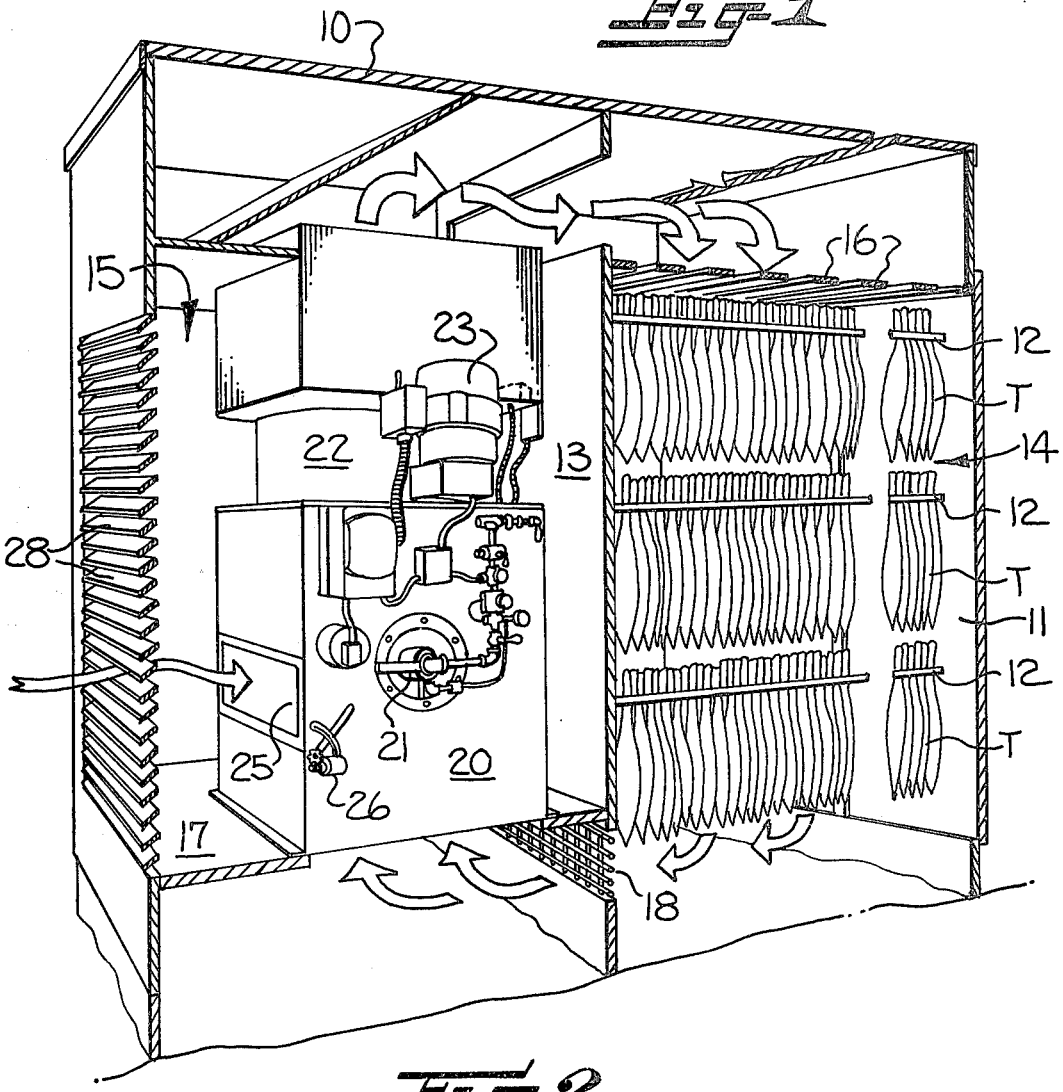
FIG. 2 is a fragmentary cross-sectional perspective view of the curing barn taken substantially along the line 2—2 of FIG. 1 and showing opposite end portion of the curing barn which houses the furnace unit.

As best seen in FIG. 2, a partition wall 13 is located interiorly of the elongate housing 10 adjacent one end thereof and divides the interior of the housing into two separate compartments, a relatively large curing chamber 14 and a furnace chamber 15.

The curing chamber 14, more particularly, extends throughout the major portion of the barn housing from the partition wall 13 adjacent one end of the elongate housing to the doors 11 at the opposite end thereof. A perforated diffuser ceiling 16 extends throughout the upper portion of the housing a short distance below the top wall of the housing and defines therebetween an elongate air passageway communicating with the curing chamber via the perforations in the ceiling 16.

Referring now more particularly to the furnace chamber 15, it will be seen that this portion of the barn includes a false floor 17 located a short distance above the bottom floor of the housing 10 and having a relatively large opening provided in the medial portion thereof. A furnace unit 20 is mounted on the false floor 17 overlying the opening therethrough and includes a burner 21, which may be fired by any suitable fuel such as natural or bottled gas, fuel oil or kerosene, and a fan 22 adapted for inducing a forced flow of air through the furnace and into and through the curing chamber. The fan 22 is powered by an electric motor 23 or other suitable means connected to the fan by suitable drive means such as belts.

In the particular embodiment illustrated, the fan 22 directs the heated air from the furnace upwardly and into the area above the perforated diffuser ceiling 16. The heated air enters the curing chamber through the perforations in the ceiling and circulates downwardly through the tobacco and returns to the furnace unit 20 through the opening in false floor 17. It will be noted that openings are provided in the upper and lower portions of the partition wall 13 and thus provide for continuous circulation of air from the curing chamber 14 through the furnace unit 20 and then back into the curing chamber 14 through the perforated false ceiling 16. Thus, it will be seen that the furnace unit 20, the area underlying false floor 17, and the area above ceiling 16 collectively define an air passageway communicating with the inlet and outlet of the curing chamber 14 for directing a largely recirculating flow of air into and through the curing chamber. As illustrated, an air permeable screen 18 may be provided in the lower opening in the partition wall 13 to prevent portions of tobacco leaves or other debris from being sucked into the furnace unit 20 by the relatively high volume flow of air generated by the fan 22.

The furnace unit 20 also includes a fresh air damper 25 which may be adjustably positioned by means of a damper positioning motor 26 between an open and a closed position in a manner to be described more fully hereinafter. In the closed position, very little fresh air is introduced into the barn and the air inside the barn is continuously recirculated. Moving the fresh air damper 25 to an opened position allows fresh air to be drawn into the furnace unit 20 to be mixed with recirculated air from the curing chamber, heated and then largely directed back into the curing chamber. Automatic outlet vents 27 (FIG. 1) of a conventional type permit air to be expelled from the curing chamber as fresh air is introduced from the fresh air damper 25. As illustrated in FIG. 2, louvers 28 provided in the wall of the housing 10 permit air to flow into the furnace chamber 15 from outside the barn when the fresh air damper 25 is in the open position.

Figure 3:
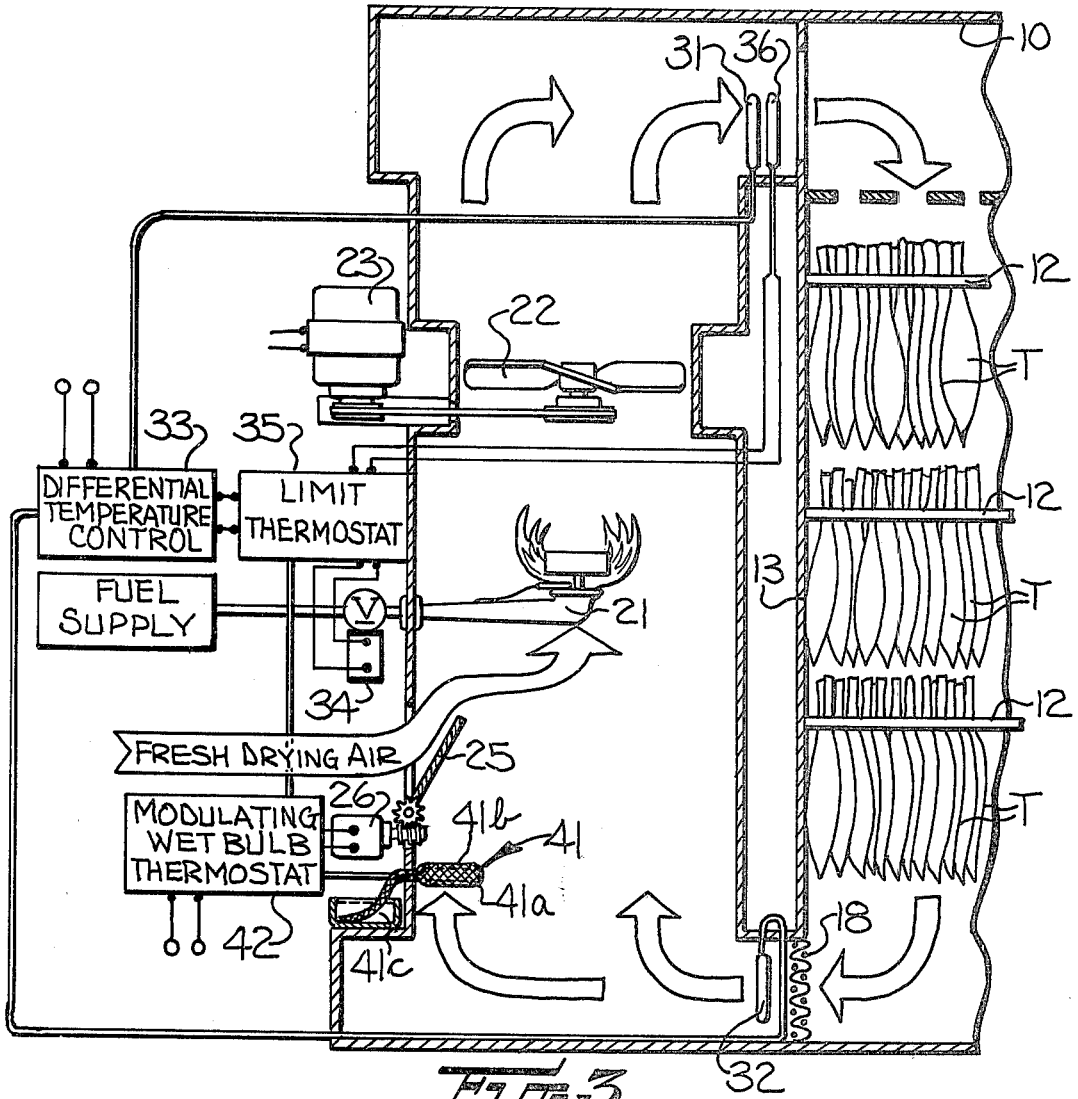
FIG. 3 is a schematic cross-sectional view showing the arrangement of the control elements used in accordance with the present invention.

Referring now more particularly to the burner control system in accordance with this invention, which may be best understood by reference to the schematic diagram of FIG. 3, it will be seen that temperature sensors 31 and 32 are located respectively in the path of air flow being directed to and from the curing chamber. Thus, temperature sensor 31 senses the dry bulb temperature of the air being directed from the furnace unit 20 to the curing chamber 14, while temperature sensor 32 senses the dry bulb temperature of the air after it has passed through the mass of tobacco in the curing chamber.

From the previous discussion it will be understood that when water is being evaporated from the tobacco in the curing chamber, the temperature of the air emerging from the tobacco, as sensed by the temperature sensor 32, will be less than the temperature of the air upon entering the tobacco, as sensed by the temperature sensor 31. The sensors 31 and 32 are connected to a differential temperature control means or thermostat 33. Differential temperature control 33 is operatively connected to a control valve 34 for the burner 21 and serves to control the operation of the burner to maintain a preselected temperature differential between sensor 31 and sensor 32. The set point of differential thermostat 33 may be suitably adjusted for maintaining a desired temperature differential between sensors 31 and 32. In the particular embodiment illustrated herein, the differential control 33 operates the burner in on/off cycles to maintain the desired temperature differential between the sensors 31 and 32. However, the principles of this invention would also be applicable for controlling a burner or heater in which the heat output could be adjustably varied or modulated.

As illustrated, the differential temperature control 33 is connected to the burner control valve 34 in series with a limit thermostat 35. A temperature sensor 36, also located in the path of air flow from the furnace unit 20 to the curing chamber 14, is connected to the limit thermostat 35 for sensing the dry bulb temperature of the air being directed to the curing chamber. The set point of the limit thermostat 35 may be adjusted as desired in order to limit the maximum temperature of the air being directed to the curing chamber. So long as the air temperature does not exceed the preselected maximum, control over the burner 21 is effected by the differential temperature control 33. By maintaining a constant temperature differential, this control brings about an increase in temperature as the moisture content of the tobacco is reduced. However, when the maximum temperature selected on the limit thermostat 35 is reached, the limit thermostat 35 overrides the differential temperature control 33 and maintains control of the burner to prevent exceeding the maximum desired temperature.

The fresh air damper 25 may, if desired, be adjusted manually during the various stages of curing. However, in accordance with a preferred embodiment of the invention, the fresh air damper 25 is adjusted automatically in accordance with the wet bulb temperature conditions within the curing chamber. More particularly, as illustrated, a wet bulb temperature sensor 41 is located in the path of air flow and is operatively connected to an adjustable modulating thermostat 42. Thermostat 42, in turn, is connected to the damper positioning motor 26 for controlling the positioning of the damper 25 in accordance with the wet bulb temperature conditions as sensed by sensor 41. As illustrated, sensor 41 is preferably located in the path of air flow from the curing chamber 14 to the furnace unit 20. However, this location is not critical since the wet bulb temperature of the air would be substantially the same on the downstream side of the furnace unit as on the upstream side thereof. The wet bulb temperature sensor element **41*a* is encased in a wick 41*b*, with the wick extending into a water reservoir 41*c*, or other suitable means for keeping the wick in a moist condition while air is being directed thereacross. The modulating thermostat 42** may be adjusted for maintaining any preselected wet bulb temperature and operates to maintain a substantially constant wet bulb temperature by effecting opening or closing of the fresh air damper. In this regard, it will be appreciated that when the humidity of the air circulating through the barn is relatively high, opening of the fresh air damper to introduce drier outside air into the curing chamber will bring about a reduction in the relative humidity of the air circulating through the curing chamber and a consequent reduction in wet bulb temperature.

Having now described the arrangement of apparatus for practicing the present invention, the following is a more detailed description of the method of operation of this apparatus and the method for curing tobacco in accordance with this invention.

Yellowing

During this first stage in the curing process, it is most important to maintain a controlled rate of dehydration. During this stage, some drying of the tobacco leaves will occur, but it is important to limit the amount of drying until yellowing has been completed. If drying proceeds too rapidly during yellowing, the color may be set in the leaves while the tobacco is still green. Normally, it is desirable to achieve a weight loss of about 15 to 20 percent during yellowing.

Since the temperature drop of the air passing through the tobacco due to evaporative cooling is an accurate indication of the rate of drying which is taking place, the present invention achieves a controlled relatively slow rate of drying during yellowing by maintaining a relatively low temperature differential across the tobacco. In accordance with the present invention, the dry bulb temperature differential across the tobacco during yellowing should be maintained within the range of about 3° to 10° F., and preferably about 5°. With a temperature differential significantly above 10° F., it has been determined that drying normally proceeds too rapidly, while a temperature differential much less than about 3° does not normally provide a sufficient rate of drying to accomplish yellowing within a reasonable period of time.

The preferred practice during yellowing is to set the differential temperature control 33 to maintain a temperature differential of about 5° F., and to set the limit thermostat 35 for a maximum temperature of about 100° F. The wet bulb thermostat 42 should be set to maintain a wet bulb temperature preferably within the range of 90° to 100° F., and most desirably to a temperature substantially corresponding to the setting on limit thermostat 35 minus the setting on differential control 33. Thus, with the differential control set at 5° F. and the limit thermostat set at 100° F., the wet bulb thermostat 42 would be set to maintain a wet bulb reading of 95° F.

Referring to the curing chart of FIG. 4, it will be seen that during the yellowing stage the temperature differential across the tobacco is maintained at approximately 5° F., with the maximum temperature reaching the 100° limit temperature at certain times, but often fluctuating below this maximum limit especially during the nighttime as the outside air cools. The actual temperature maintained during yellowing is largely dependent upon ambient temperature. Thus, during relatively hot weather, the maximum temperature may remain at or near the upper limit of 100° and under the control of the limit thermostat 35, whereas during colder weather the temperature during yellowing may never reach the maximum limit of 100° and the burner would be solely controlled by the differential temperature control 33. In any event, it will be appreciated that maintaining a controlled temperature differential across the tobacco during yellowing insures that an excessive rate of drying does not occur during this time.

This feature of the invention is particularly valuable in locations which are subject to large temperature variations between daytime and nighttime. Under such conditions, an arbitrary curing schedule might bring about premature setting of the color of the tobacco before yellowing is completed. For example, if the arbitrary curing schedule called for maintaining a 100° dry bulb temperature during yellowing and the outside temperature fell to 50° or 60° F., the burner, in order to maintain the 100° temperature within the barn, could easily cause overdrying of the tobacco. Under the differential temperature control method of the present invention, however, the actual temperature within the barn may fall significantly below the 100° level in order to maintain no more than a 5° temperature differential across the tobacco.

During the yellowing stage of curing, the automatically controlled fresh air dampers can contribute to maintaining the desired temperature differential across the tobacco. Thus, when the air entering the tobacco is at or near the maximum limit temperature of 100° and the wet bulb temperature begins to exceed the 95° setting, the fresh air damper will be opened to introduce lower temperature drier outside air to assist in maintaining the desired temperature differential.

Color Setting and Drying

When it has been determined that the tobacco has been properly yellowed, it is important to promptly set the color in the tobacco and initiate drying in order to prevent the yellowing process from continuing too far and resulting in the tobacco turning brown. In accordance with the present invention this is accomplished by raising the set point for the differential temperature control 33 and the high limit thermostat 35. Preferably, the differential control 33 is set to maintain a differential temperature within the range of 15° to 25° F., and most desirably about 20° F. The high limit thermostat 35 is set to a limit typically within the range of 155° F. to 165° F., and preferably about 160° F. Also, the wet bulb thermostat 42 is set to maintain a substantially constant wet bulb temperature preferably within the range of 90° to 100° F.

Figure 4:
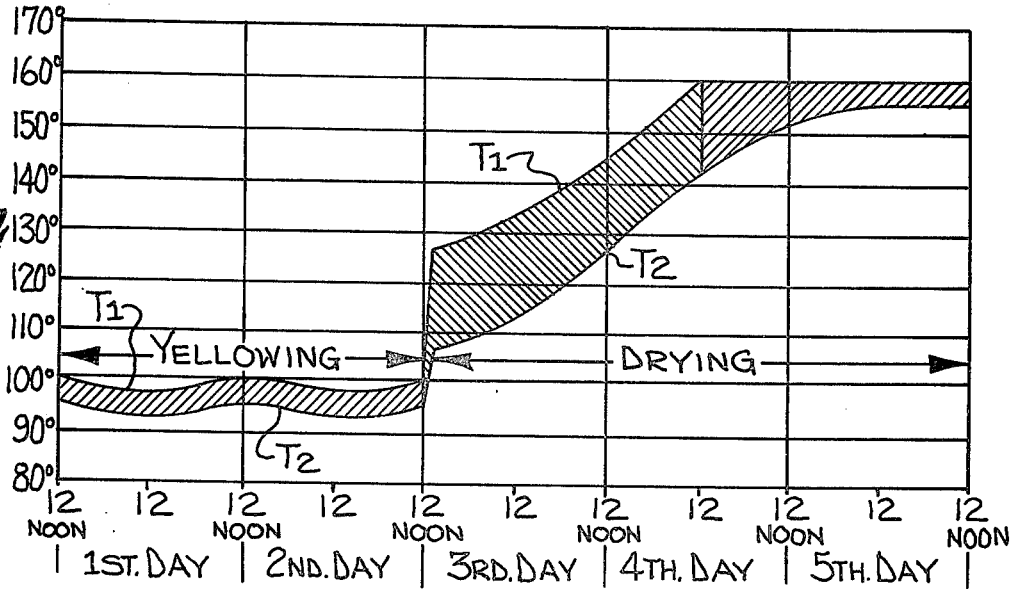
FIG. 4 is a graph showing the time and temperature relationships during a typical cure utilizing the features of the present invention.

Referring to the curing chart of FIG. 4, it will be seen that upon resetting the thermostats 33, 35 and 42 the temperature of the air being directed into the curing chamber (T1) increases relatively rapidly from the yellowing temperature (e.g., 100° F.) to about 125° F. and then increases at a relatively gradual rate up to the maximum limit temperature of 160°. The temperature of the air emerging from the tobacco (T2) follows this gradually increasing curve, but about 20° lower than the inlet air temperature (T1) as a result of the setting on the differential temperature control. The rapid rise in temperature upon resetting the thermostats is contrary to the practice of gradually advancing the temperature, which is the conventional practice in the art. This rapid rise in temperature, which facilitates rapidly setting the color in the tobacco, is made possible due to the effective control maintained by the differential temperature control 33. Control 33 allows the temperature to initially rise as rapidly as possible, but prevents an excessively large temperature differential from occurring which would create conditions under which scalding could occur. The leaves initially give up their moisture relatively easily and this keeps the rate of temperature advance slow.

During the drying stage it is important that the tobacco in the barn be dried at a controlled rate, and this is accomplished in accordance with the present invention by maintaining a predetermined temperature differential within the previously stated range (i.e., 15° to 25° F.). This prevents the temperature of the tobacco on the inlet side of the curing chamber from becoming so much warmer than tobacco downstream therefrom that moisture could condense on the cooler downstream leaves and "scald" the tobacco. This further insures that the tobacco in the lowest level in the barn will not be too far behind the tobacco at the top level.

Referring again to the curing chart of FIG. 4 it will be seen that during the later stages of drying, particularly after the inlet temperature (T1) has reached the upper limit, the inlet and outlet temperatures (T1 and T2) begin to converge as the tobacco dries out and less evaporative cooling of the air takes place.

During the drying stage, the 100° wet bulb thermostatic control of the fresh air damper 25 will initially cause the fresh air damper to be positioned in a partly open position to introduce relatively dry outside air into the curing chamber and to expel moisture laden air from the outlet vents 27. However, as the drying of the tobacco progresses and the relative humidity inside the curing chamber decreases, the dampers will be automatically brought to a more closed position to conserve fuel. During the later stages of the curing very little moisture remains in the tobacco, which reduces the wet bulb temperature and closes the damper to save fuel.

When the stem portions of the leaves have been sufficiently dried, as determined by the operator, the burner may be turned off. The final step prior to removal of the tobacco from the barn is to order the tobacco. This final step allows the tobacco to regain a portion of the moisture previously removed by drying to prevent the leaves from being too brittle and to thereby facilitate handling. Ordering of the tobacco is done in a conventional manner, as for example by circulating moist air through the tobacco by the fan with the burner inoperative.

It should be understood that while the present invention has been described with reference to a bulk curing barn of the type wherein heated air is circulated downwardly through the tobacco, the principles of this invention are equally applicable to other conventional bulk curing systems, including those in which the heated air is circulated upwardly through the tobacco. Similarly, while the bulk curing barn illustrated herein is shown with three tiers of tobacco racks in the curing chamber, the principles of this invention are equally applicable to curing barns having tobacco racks arranged differently, and to curing barns of the type wherein tobacco is placed in the curing chamber in containers rather than on racks.

In the drawings and specification, there has been set forth a preferred embodiment of the invention, and although specific terms are employed, they are used in a generic and descriptive sense only and not for purposes of limitation.

That which is claimed is:

1. An apparatus for bulk curing tobacco comprising a curing barn, means in said curing barn defining a tobacco curing chamber adapted for receiving tobacco leaves for curing and including an inlet and outlet for the flow of air in and out of the curing chamber, means defining an air passageway communicating with the inlet and outlet of the curing chamber for directing air in a recirculating flow into and through the curing chamber, a fan cooperating with said air passageway for inducing a forced flow of air therealong and through the curing chamber and into contact with the tobacco leaves disposed in the curing chamber, a heater cooperating with said air passageway for heating the air flowing along the air passageway and through the curing chamber, first and second dry bulb temperature sensing means located in the path of air flow respectively adjacent the inlet and outlet of the curing chamber for sensing the differential in temperature of the air upon entering and leaving the curing chamber, which temperature differential is a function of the rate of drying of the tobacco within the curing chamber, and differential temperature control means operably associated with said heater and responsive to said first and second temperature sensing means for controlling the rate of drying of the tobacco by controlling the operation of the heater to vary the temperature of the air entering the curing chamber so as to maintain a predetermined differential in dry bulb temperature between the first and second temperature sensing means and thus provide an optimum rate of drying for tobacco of varying drying characteristics.

2. An apparatus according to claim 1 wherein said differential temperature control means includes means to permit adjustment of the predetermined differential in dry bulb temperature maintained between the first and second temperature sensing means.

3. An apparatus according to claim 1 including a third dry bulb temperature sensing means located in the path of air flow adjacent the inlet of the tobacco curing chamber and operable for sensing the dry bulb temperature of the air upon entering the curing chamber, and a high temperature limit control operably associated with said heater and responsive to said third dry bulb temperature sensing means for overriding said differential temperature control means and controlling the operation of said heater upon the air entering the curing chamber reaching a predetermined maximum desired temperature.

4. An apparatus according to claim 3 wherein said high temperature limit control includes means for effecting adjustment of the predetermined maximum temperature at which the high temperature limit control overrides the differential temperature control means.

5. An apparatus for bulk curing tobacco comprising a curing barn, means in said curing barn defining a tobacco curing chamber adapted for receiving tobacco leaves for curing and including an inlet and outlet for the flow of air in and out of the curing chamber, means in said barn defining an air passageway communicating with the inlet and outlet of the curing chamber for directing air in a recirculating flow into and through the curing chamber, a fan cooperating with said air passageway for inducing a forced flow of air therealong and through the curing chamber and into contact with the tobacco leaves disposed in the curing chamber, a heater cooperating with said air passageway for heating the air flowing along the air passageway and through the curing chamber, damper means cooperating with said air passageway for controlling the introduction of outside air into the passageway for thereby varying the humidity conditions inside the curing chamber, first and second dry bulb temperature sensing means located in the path of air flow respectively adjacent the inlet and outlet of the curing chamber and operable for sensing the dry bulb temperature of the air upon entering and leaving the curing chamber, differential temperature control means operably associated with said heater and responsive to said first and second dry bulb temperature sensing means for controlling the operation of the heater so as to maintain a predetermined differential in dry bulb temperature between said first and second temperature sensing means, wet bulb temperature sensing means located in the path of air flow for sensing the wet bulb temperature of the recirculating flow of air, and means operably associated with said damper means and responsive to said wet bulb temperature sensing means for controlling the positioning of the damper means to maintain the recirculating air at a predetermined substantially constant wet bulb temperature.

6. An apparatus for bulk curing tobacco comprising a curing barn, means in said curing barn defining a tobacco curing chamber adapted for receiving tobacco leaves for curing and including an inlet and outlet for the flow of air in and out of the curing chamber, means in said barn defining an air passageway communicating with the inlet and outlet of the curing chamber for directing air in a recirculating flow into and through the curing chamber, a fan cooperating with said air passageway for inducing a forced flow of air therealong and through the curing chamber and into contact with the tobacco leaves disposed in the curing chamber, a heater cooperating with said air passageway for heating the air flowing along the passageway and through the curing chamber, damper means cooperating with said air passageway for controlling the introduction of outside air into the passageway for thereby varying the humidity conditions inside the curing chamber, first and second dry bulb temperature sensing means located in the path of air flow respectively adjacent the inlet and outlet of the curing chamber and operable for sensing the dry bulb temperature of the air upon entering and leaving the curing chamber, differential temperature control means operably associated with said heater and responsive to said first and second dry bulb temperature sensing means for controlling the operation of the heater so as to maintain a predetermined differential in dry bulb temperature between the first and second temperature sensing means, said differential temperature control means including manually actuable means to permit adjustment of the predetermined temperature differential maintained between the first and second temperature sensing means, a third dry bulb temperature sensing means located in the path of air flow adjacent the inlet of the tobacco curing chamber and operable for sensing the dry bulb temperature of the air upon entering the curing chamber, a high temperature limit control operably associated with said heater and responsive to said third dry bulb temperature sensing means for overriding said differential temperature control means and controlling the operation of said heater upon the air entering the curing chamber reaching a predetermined maximum desired temperature, said high temperature limit control means including means for effecting adjustment of the predetermined maximum temperature at which the high temperature limit control overrides said differential temperature control means, wet bulb temperature sensing means located in the path of air flow for sensing the wet bulb temperature of the recirculating flow of air, and means operably associated with said damper means and responsive to said wet bulb temperature sensing means for controlling the positioning of the damper means to maintain the recirculating air at a predetermined substantially constant wet bulb temperature.

7. A method for curing tobacco in a tobacco bulk curing barn comprising directing air in a recirculating flow into and through a curing chamber of the barn and into contact with tobacco leaves disposed in the curing chamber while sensing the differential in dry bulb temperature of the air entering and leaving the curing chamber, which temperature differential is a function of the rate of drying of the tobacco within the curing chamber, and while controlling the rate of drying of the tobacco by heating the air directed into the curing chamber in response to the sensed temperature differential of the air so as to maintain a predetermined differential in the dry bulb temperature of the air entering and leaving the curing chamber and thus provide an optimum, rate of drying for tobacco of narying drying characteristics.

8. A method according to claim 7 including the step of discontinuing the maintaining of a predetermined differential in dry bulb temperature in response to the air entering the curing chamber reaching a predetermined maximum dry bulb temperature, and maintaining the air at a temperature not exceeding said predetermined maximum dry bulb temperature.

9. A method according to claim 7 wherein the heating of the air in a controlled manner is performed to maintain a predetermined substantially constant differential in dry bulb temperature within the range of about 3° to 10° F. from the time the curing begins until yellowing is completed except for such times as the air directed into the tobacco reaches a predetermined maximum dry bulb temperature, and upon the air directed into the tobacco reaching said predetermined maximum temperature, maintaining the air at a temperature not exceeding said predetermined maximum desired dry bulb temperature.

10. A method according to claim 7 wherein the heating of the air in a controlled manner is performed to maintain a predetermined substantially constant differential in dry bulb temperature within the range of about 15° to 25° F. from the time yellowing is completed until such time as the air directed into the tobacco reaches a predetermined maximum dry bulb temperature, and upon the air reaching said predetermined maximum temperature, maintaining the air at a temperature not exceeding said predetermined maximum desired dry bulb temperature.

11. A method according to claim 7 including also sensing the wet bulb temperature of the air circulating through the curing barn and controlling the introduction of outside air into the curing barn to maintain a predetermined substantially constant wet bulb temperature.

12. In a method for curing tobacco in a tobacco bulk curing barn wherein air is directed in a recirculating flow into and through a curing chamber of the barn and into contact with tobacco leaves disposed in the curing chamber while the air is heated to effect curing of the tobacco in the curing chamber, the improved method of controlling the heating of the air in the curing barn during the yellowing stage in the curing process and during the subsequent drying stage, said method comprising controlling the heating of the air during yellowing to maintain the air entering and leaving the curing chamber at a predetermined substantially constant dry bulb temperature differential within the range of about 3° to 10° F., but while preventing the air entering the curing chamber from exceeding a temperature of about 100° F., and upon the tobacco reaching a desired degree of yellowing, then controlling the heating of the air during drying to maintain the air entering and leaving the curing chamber at a predetermined substantially constant dry bulb temperature differential within the range of about 15° to 25° F., but while preventing the air entering the tobacco from exceeding a maximum temperature of about 165° F.

13. The method according to claim 12 including controlling the introduction of outside air into the curing barn during said yellowing stage of the curing process so as to maintain the air circulated in the curing chamber at a predetermined substantially constant wet bulb temperature within the range of about 90° to 100° F.

14. The method according to claim 12 including controlling the introduction of outside air into the curing barn during said drying stage of the curing process so as to maintain the air circulated in the curing chamber at a substantially constant wet bulb temperature within the range of from 90° F. to 100° F.

* * * * *

UNITED STATES PATENT OFFICE

CERTIFICATE OF CORRECTION

PATENT NO. : 4,192,323

DATED : March 11, 1980

INVENTOR(S) : William P. Horne

It is certified that error appears in the above-identified patent and that said Letters Patent are hereby corrected as shown below:

Column 1, line 47, "to" should be --at--; column 13, Claim 7, line 21, "narying" should be --varying--.

Signed and Sealed this

*Tenth* Day of *June 1980*

[SEAL]

*Attest:*

SIDNEY A. DIAMOND

*Attesting Officer*

*Commissioner of Patents and Trademarks*